United States Patent [19]

Rusche

[11] 4,280,772

[45] Jul. 28, 1981

[54] LEADLESS METHOD AND APPARATUS FOR DRIVING PILES

[76] Inventor: Fredric Rusche, 30303 Beck Rd., Wixom, Mich. 48096

[21] Appl. No.: 20,530

[22] Filed: Mar. 14, 1979

[51] Int. Cl.[3] ..... E02D 7/06

[52] U.S. Cl. ..... 405/232; 173/43; 173/132

[58] Field of Search ..... 405/228, 232; 173/28, 173/43, 132; 308/4 R, 6 A, 202

[56] References Cited

U.S. PATENT DOCUMENTS

| | | | |
|---|---|---|---|
| 994,538 | 6/1911 | Roovaart | 173/132 |
| 1,157,444 | 10/1915 | Stewart | 405/232 |
| 2,909,393 | 10/1959 | Price et al. | 308/4 R |
| 3,242,997 | 3/1966 | Tokola | 405/232 X |
| 3,312,291 | 4/1967 | Haug | 173/28 |
| 3,827,508 | 8/1974 | MacKinnon | 405/232 X |
| 3,888,317 | 6/1975 | Walters | 173/43 |
| 4,131,166 | 12/1978 | Schnell | 173/43 |

*Primary Examiner*—David H. Corbin
*Attorney, Agent, or Firm*—James H. Littlepage

[57] ABSTRACT

A pile is lofted to a vertical position over a driving location. At a distance above its lower end the pile is embraced within a guide on an extensible rack on the crane chasis. Over the upper end of the pile a vertically elongate socket on the lower end of a hammer carriage is fitted, and driving ensues until the pile is self-sustaining, or until the hammer carriage nears the rack. Then the rack is disengaged from the pile and withdrawn, and driving is completed.

9 Claims, 12 Drawing Figures

FIG. 7
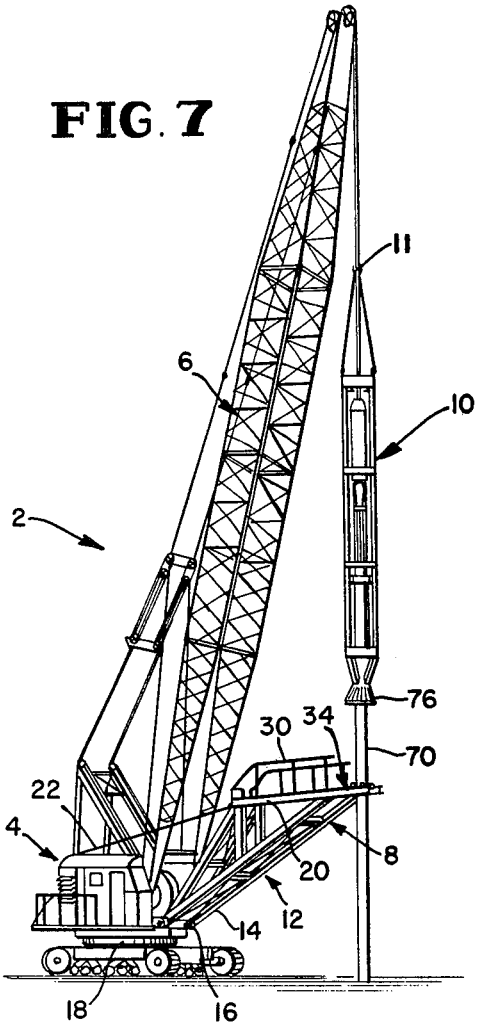
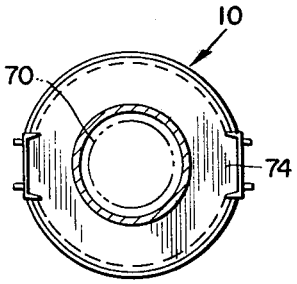
FIG. 9
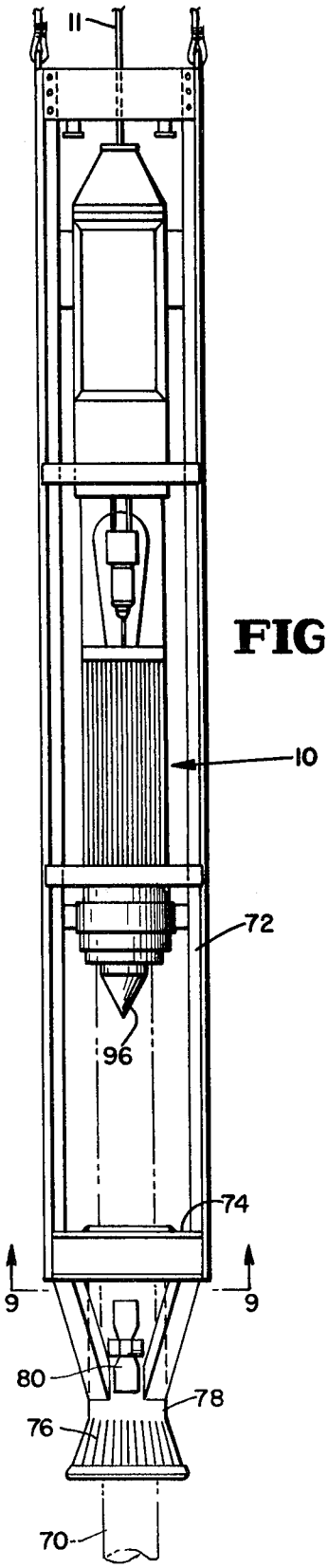
FIG. 8

LEADLESS METHOD AND APPARATUS FOR DRIVING PILES

FIELD OF INVENTION

Hydraulic and earth engineering, piles, with installation.

PRIOR ART

Goldsborough et al. U.S. Pat. No. 1,957,999; Haug U.S. Pat. No. 3,312,291; Johansson U.S. Pat. No. 3,365,004; Lake, U.S. Pat. No. 3,490,548; Childress U.S. Pat. No. 4,076,337.

BACKGROUND OF THE INVENTION

Hitherto, most hammer-driving of long piles has entailed the use of leads which are usually mounted on a crane. A pile is engaged in the leads and a hammer, sliding on a trackway in the leads, drives the pile into the ground. Such leads may be as much as 120′ or more in height. Not only are they expensive and cumbersome, but there is an element of danger, particularly for the loftsman. Leadless driving with a so-called "wild hammer" is generally unsatisfactory because of difficulties first in locating and holding the lower end of the pile precisely at the spot where it is to be driven, and secondly, in hitting hammer blows squarely onto the top of the pile, and thirdly, in getting the pile to go straight down. While leadless sonic hammer pile driving is useful in some situations, there are earth formations in which hammer-blow driving is superior. Besides the rapidly moving eccentric weights of a sonic hammer cause serious maintenance problems.

OBJECTS

The primary object of this invention is to provide for hammer-blow pile driving, without the use of leads, wherein the lower end of a pile is maintained precisely on the spot where the pile is to be driven, and wherein the upper end of the pile is held captive within an elongate vertical socket in the lower end of a carriage in which a hammer is mounted. More particularly, it is intended to provide a rack on a crane chasis with guide rollers on the free end of the rack which embrace the pile a substantial distance above the ground, and a hammer carriage assembly which engages over the upper end of the pile, not only holding the pile upright but also assuring square, straightdown hammer blows on the top of the pile. Preferably, the rack is extensible although it is possible to perform the method with a non-extensible rack by jockeying the crane back and forth.

A more specific object is to provide an extensible rack for a crane chassis, the rack having an inner non-extensible portion which is mounted on the crane chassis, and an extensible outer portion which slides inwardly and outwardly on the inner portion. On the outer end of the rack is a roller guide mechanism which can close and open so as to embrace and release the pile, and on the top of the rack is a gangway so that a workman can walk out to the outer end of the rack and direct the movements to the right or left of the crane, the inward and outward movements of the rack, and the engagement of the hammer carriage over the upper end of the pile.

Still another object is to provide a vertically elongate hammer carriage in which a lower end portion constitutes a socket for engaging over the upper portion of the pile. More particularly, the invention includes a truncated cone-like entryway at the bottom of the carriage and rollers on spring-biased lever arms above the entryway, which rollers engage the pile and center the socket around it. With these, plus a conical locator nose on the hammer at the upper end of the socket which engages into the upper end of the pile, considerable leverage which tends to hold the pile upright, and which centers the hammer directly over the pile is exerted between the pile and the hammer carriage.

These and other objects will be apparent from the following specification and drawings, in which:

FIG. 7 is a perspective view of the rig with the pile embraced within roller guides on the end of the rack, and with the upper end of the pile engaged in the pile socket on the hammer carriage;

FIG. 8 is a side elevation of the hammer carriage;

FIG. 9 is a cross-section along the Line 9—9 of FIG. 8;

Figure 2:
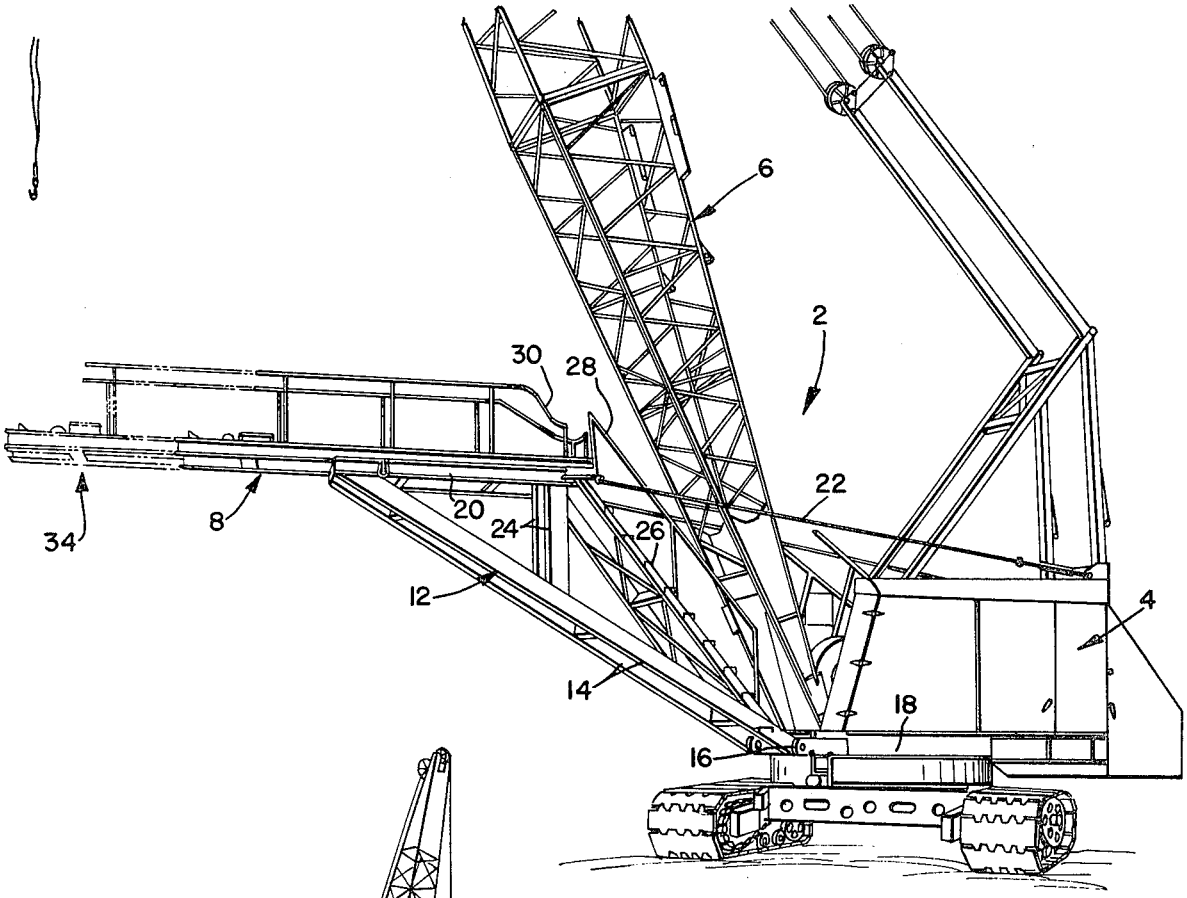
FIG. 2 is a perspective view of the lower portion of the rig and the rack.
Figure 1:
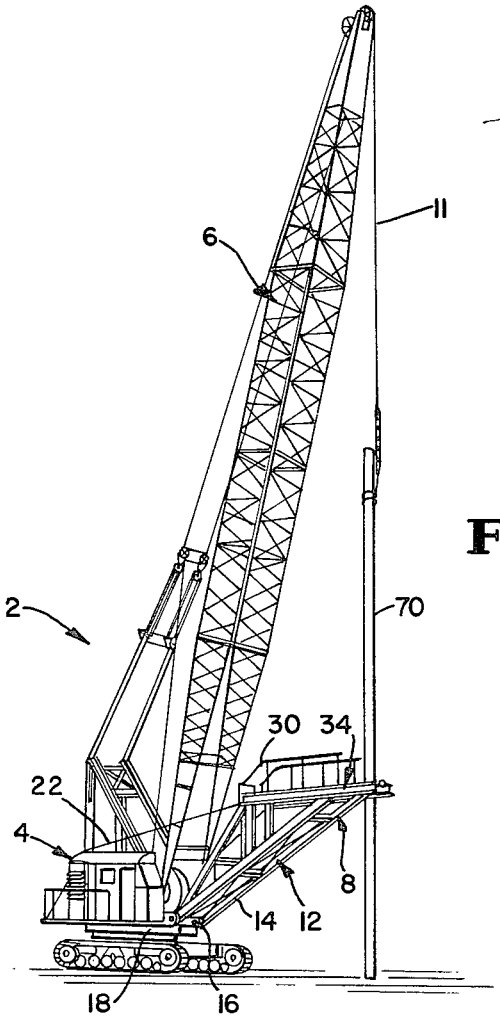
FIG. 1 is a perspective view of the pile lofted and with rack guides embracing the lower portion of the pile.
Figure 3:
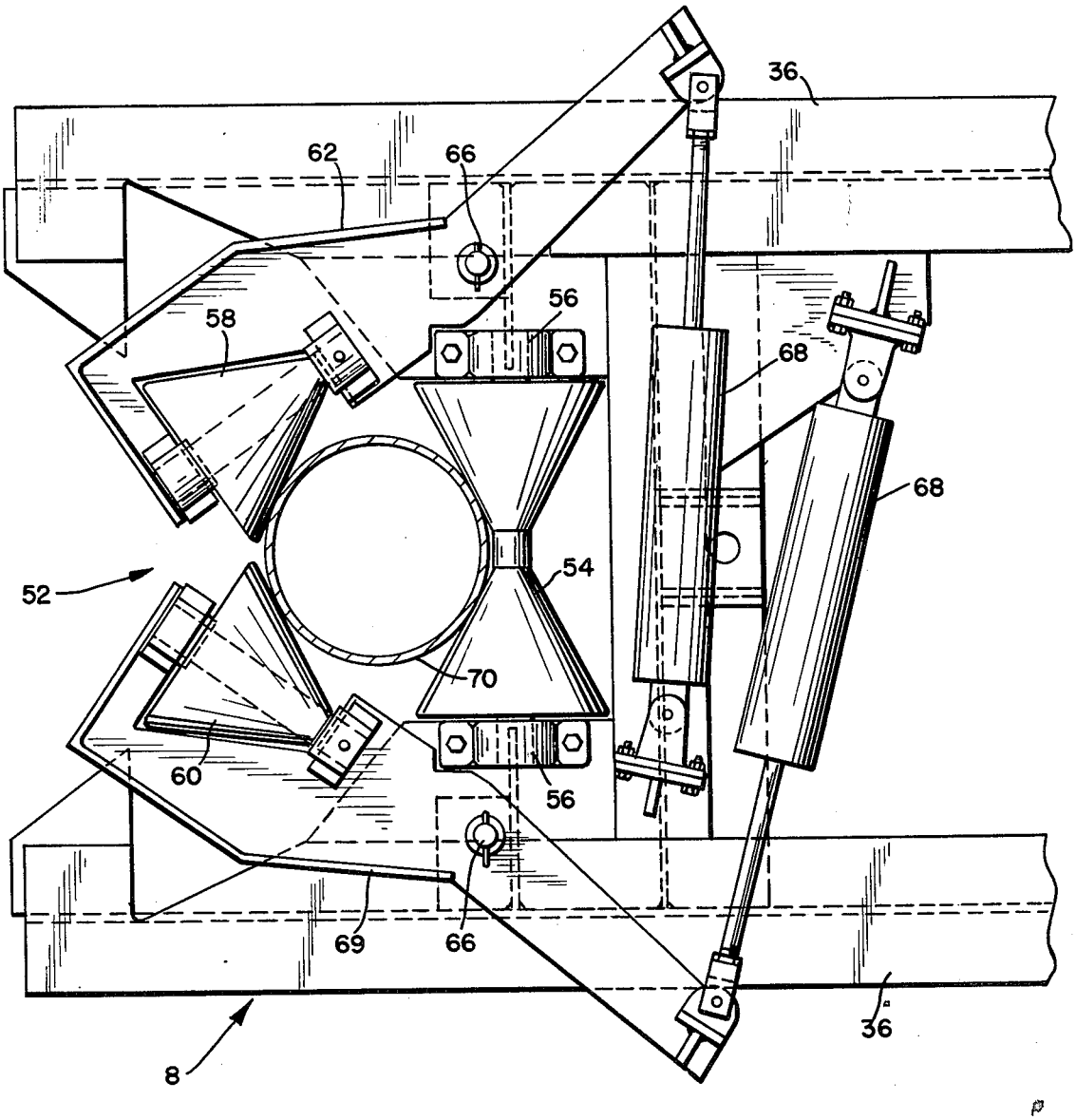
FIG. 3 is a plan view of the end of the rack with the guides embracing a pipe pile.

Referring now to the drawings, in which like reference numerals denote similar elements, the rig 2 shown generally in FIGS. 1, 2, and 7, is comprised of a crane 4, having a boom 6, a rack 8 with a guide 52 (FIG. 3) on the front end of the crane and a hammer assembly 10 suspended from the upper end of the crane boom 6 by line 11. Alternatively, the hammer may be suspended from one line and the hammer carriage from another line, each line being connected to a separate drum on the crane. Because the rack 8 and hammer assembly 10 are the novel structural features with which the method is practiced, most of the specification will be focused on them.

Referring particularly to FIGS. 1 through 6, rack 8 is comprised of an inner non-extensible portion 12 and an outer extensible portion 34. The inner portion might be considered as an oblique triangle whose legs are represented by members 14, 20 and 26. Members 24 could be considered altitudes of this triangle perpendicular to members 20. These members 20 also extend beyond members 14 and constitute the upper fixed portion of the rack. Members 14 are pin connected to the machinery deck of the crane at 16. The fixed portion of the rack is also attached to the crane by cables 22 which are anchored to members 20 of the fixed rack. A ladder 26 leads up to the top of the inner portion of the rack and rails 28, 30, and a grating 32 are provided for a workman to climb up on it. As seen best in FIGS. 4-6, the extensible part 34 of the rack is formed of a pair of I-beams 36 whose bottom flanges 38 slide within guides 40 on the upper flanges 42 of those I-beams 20 which constitute the altitude members of the right-triangular fixed inner portion of the rack 8. A grating 44 and suitable cross-framing members 45 extend between the I-beams 36, and rails 46, 48 on opposite sides of the extensible rack portion 34 to form a gangway so that a workman can walk out to the end of it. A multi-stage hydraulic jack 50 connected between the non-extensible portion 20 and the extensible portion 34 of the rack moves the latter inwardly and outwardly and, of course, the rack may be swung from one side or the other by turning the crane.

On the outer end of the extensible part 34 of the rack is a pile guide, denoted generally at 52, comprised of a double-taper roller 54 rotatably supported between the I-beams 36 by bearings 56, and a pair of single-taper rollers 58, 60 rotatably mounted on the free ends of levers 62, 69, whose intermediate portions are pivotally supported as at 66 on the I-beams. The inner arms of the levers are connected to rams of hydraulic jacks 68 and 68′ whose cylinders are respectively supported on the I-beams. By actuating the hydraulic jacks 68 and 68′, the rollers 58 and 60 can be spread apart, as in FIG. 4, to admit a pile 70 between them, and by reverse actuation of the hydraulic jacks, rollers 58 and 60 are swung in so as to embrace a pile 70 which has been admitted between them.

Figure 4:
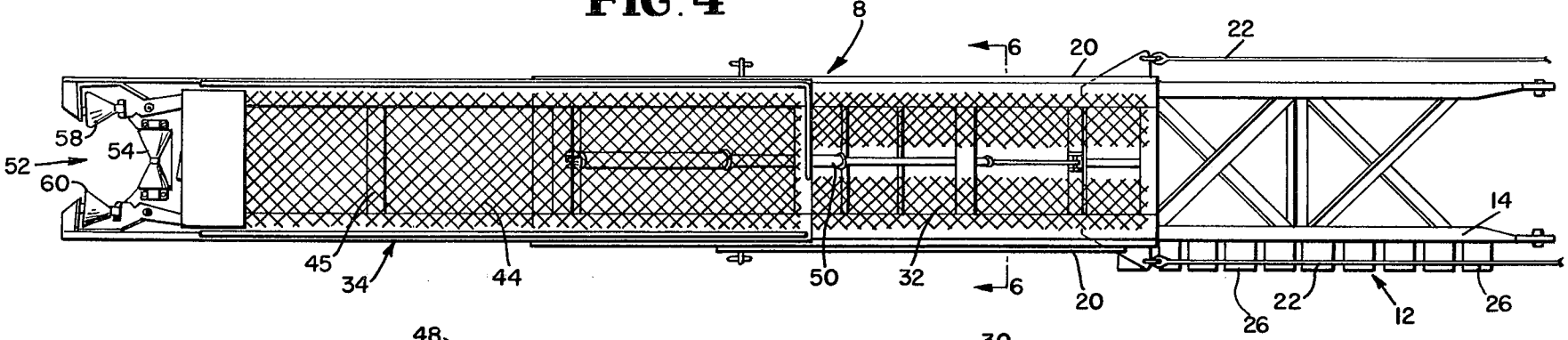
FIG. 4 is a plan view of the rack.
Figure 5:
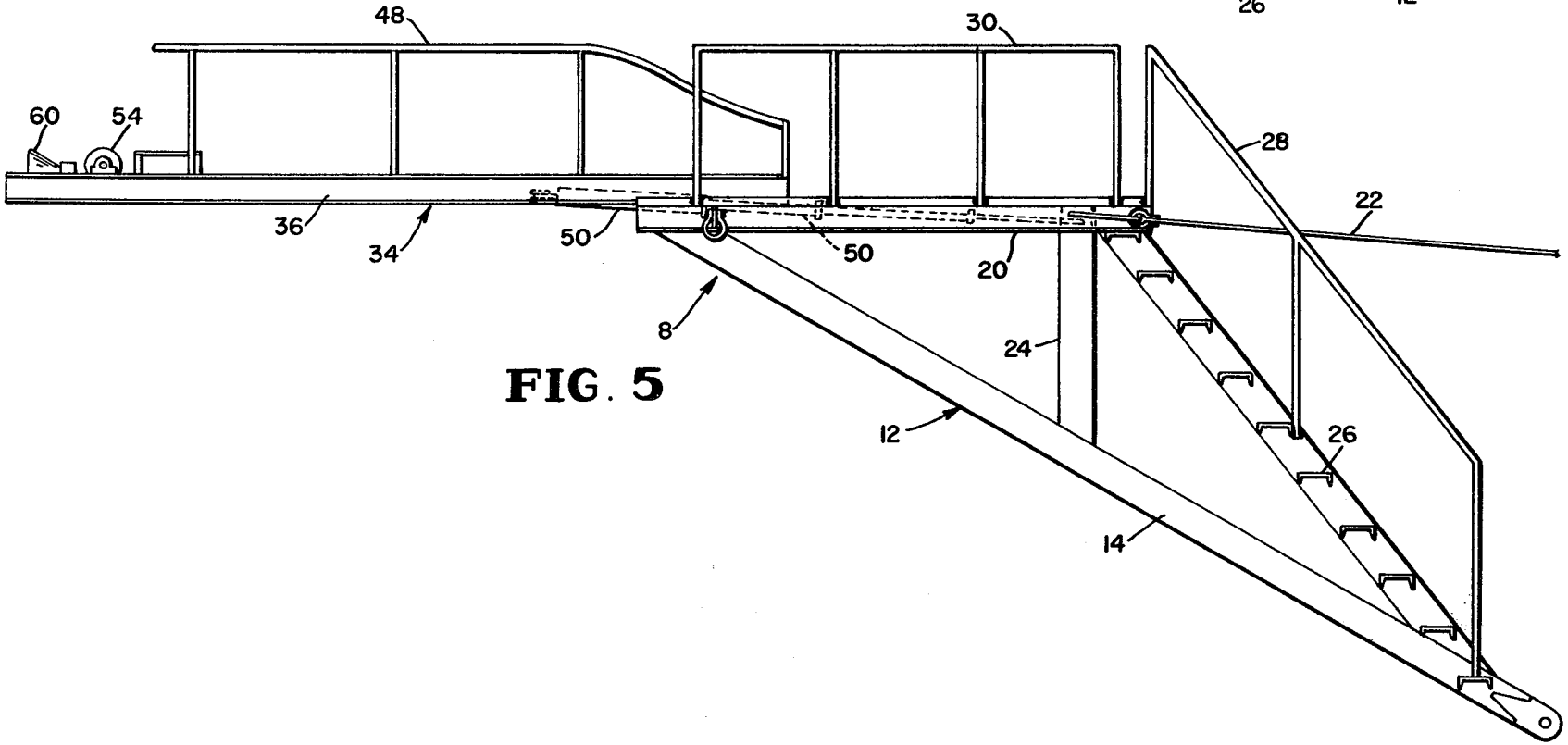
FIG. 5 is a side elevation of the rack.
Figure 6:
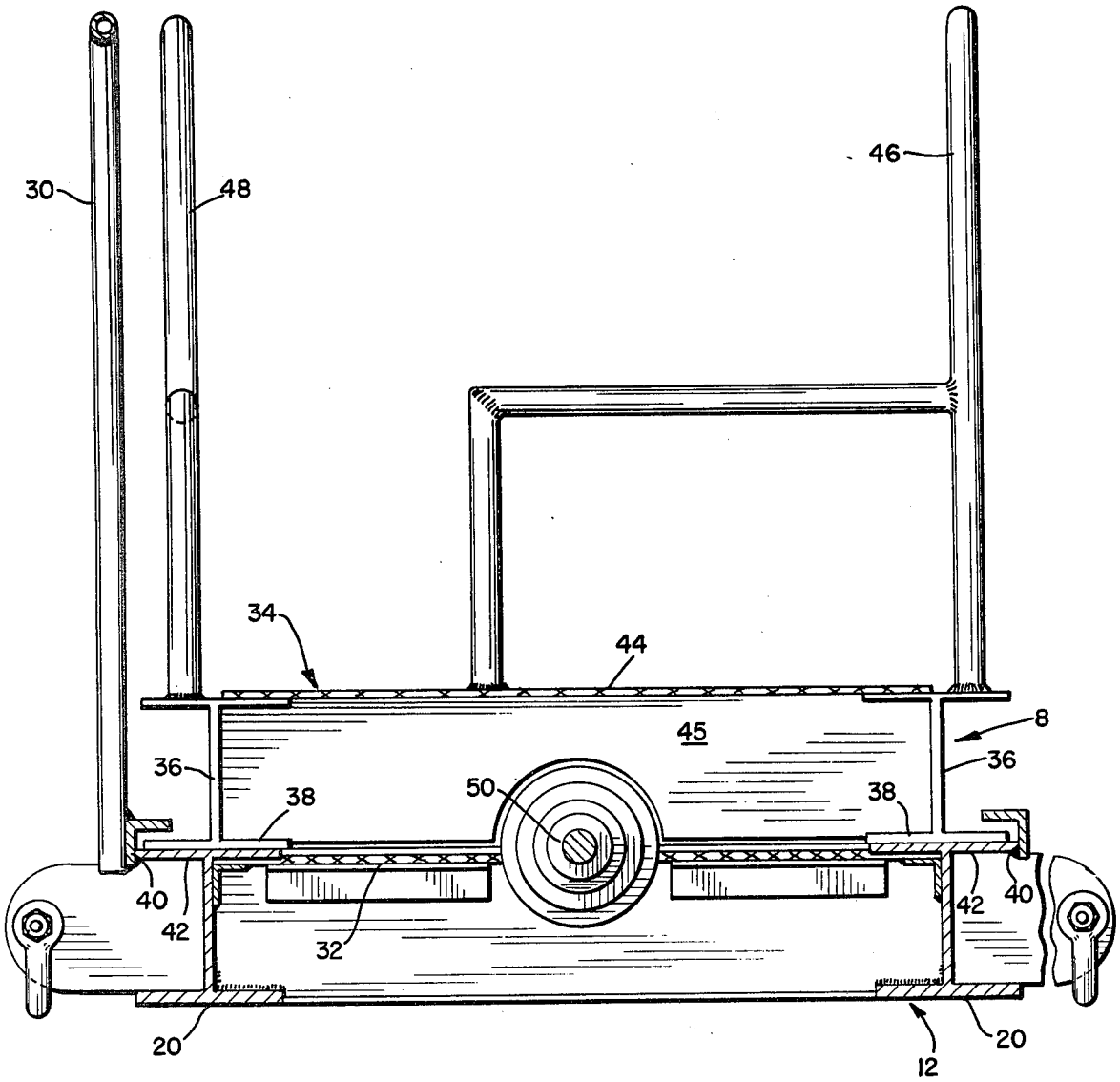
FIG. 6 is a cross-section along the line 6—6 of FIG. 4.
Figure 12:
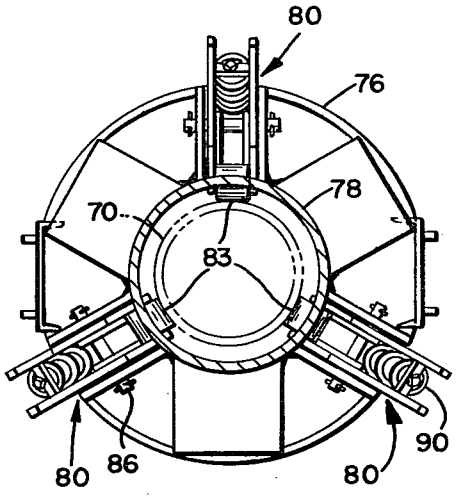
FIG. 12 is a cross-section along the Line 12—12 of FIG. 10.

In the operation of the apparatus thus-far described, a pile is lofted, as shown in FIG. 1, the extensible part 34 of the rack is moved out by the multistage hydraulic jack 50, the rollers 58 and 60 then being spread apart as in FIG. 4, and then hydraulic jacks 68 and 68′ are actuated so that the pile 70 is hugged by the rollers. This will maintain the pile upright while the hammer assembly is being installed. Then the upper end of the pile is disconnected from the crane cable 11, and the hammer assembly 10, then suspended from the crane cable 11, is lowered down onto the top of the pile as detailed hereinafter.

Alternatively, the operation may be commenced by pre-excavating a hole in the ground at the proposed pipe location by means of wet-drilling, augering, or by pulling a plug with a pre-excavation device, and by setting the lower end of the pile down into the hole before driving starts.

Figure 11:
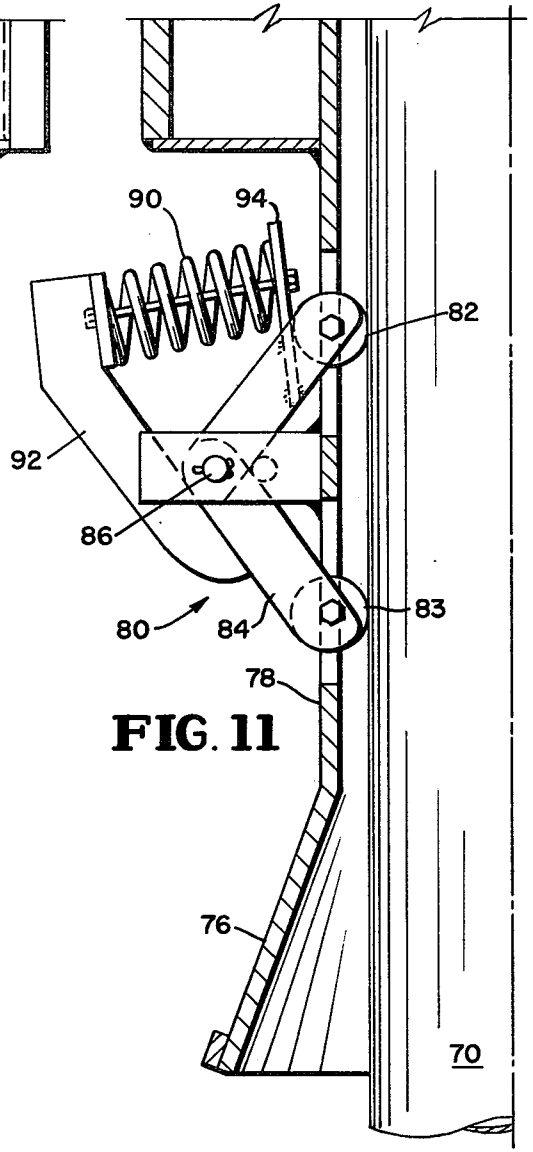
FIG. 11 is a fragmentary cross-section along the Line 11—11 of FIG. 10.
Figure 10:
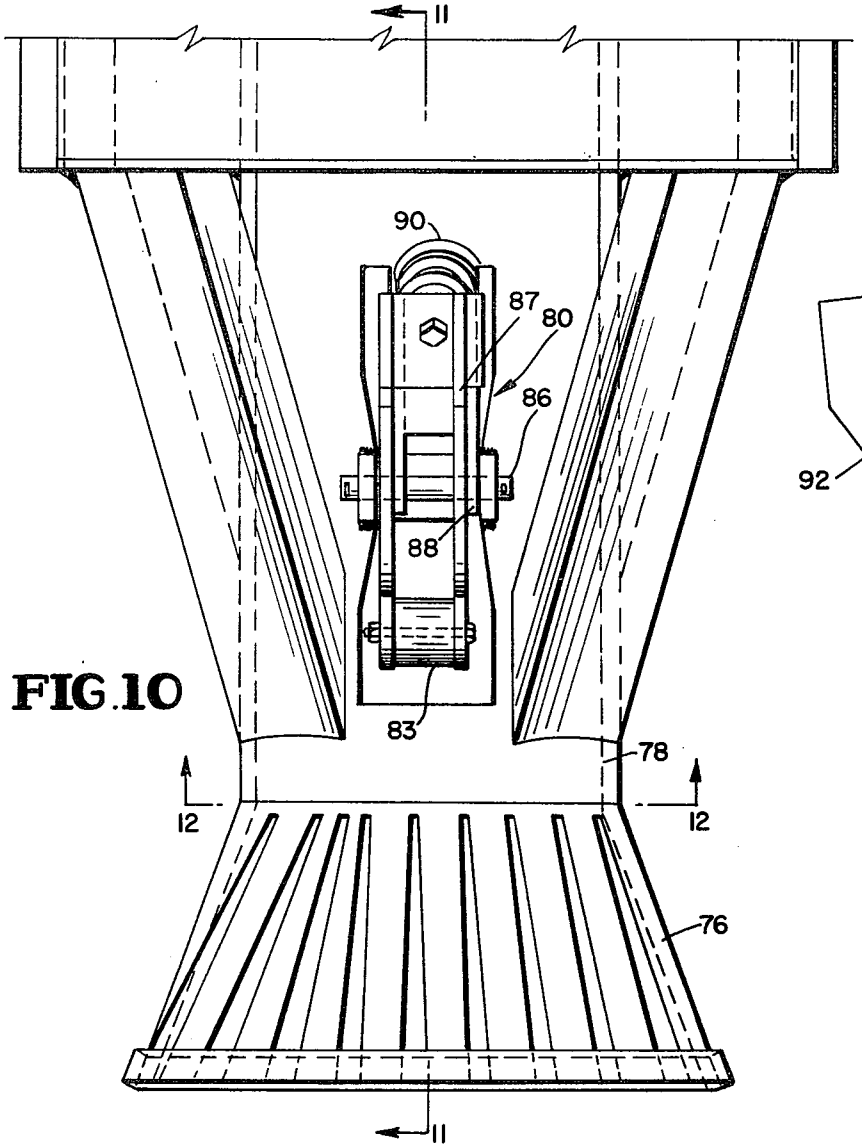
FIG. 10 is an enlarged side elevation of the lower portion of the hammer carriage.

Hammer assembly 10 is mounted in an elongate carriage 72 whose lower end portion 74 functions as a socket which fits over the upper end of the pile. The hammer assembly may be fixed in the carriage or it may be slidable therein. On the lower end of the hammer assembly is a nozzle 76 which flares outwardly from a tube 78 within which the upper end portion of the pile is to be disposed. Three resilient guide assemblies 80 are disposed equidistantly around tube 78. Each guide assembly consists of a pair of rollers 82, 83, on free ends of rigid bell-crank levers 84 which are pivoted at their intermediate portions, as at 86, on brackets 88 mounted on tube 78. Compression springs 90 engage between abutment arms 92 on brackets 88, the compression springs 90 being under compression between arms 92 and ears 94 affixed on bell-crank levers 84, so that compression springs 90 normally bias the bell-crank levers to swing clockwise, as seen in FIG. 11. Thus, the lower rollers 83 are relatively outwardly disposed from the position shown in FIG. 11 and the upper rollers 82 are inwardly disposed. When the socket of the hammer assembly is fitted over the upper end of the pile the latter, when it passes between rollers 82, forces them outwardly so that, as the hammer chassis moves further downwardly over the upper portion of the pile, the rollers assume the positions shown in FIG. 11. If the pile is of less diameter than the one illustrated, the upper rollers 82 will hold it centered in the hammer assembly. A tapered nose 96 on the lower end of hammer 10 engages within the upper end of the pipe pile. The hammer assembly tends to hang straight because of its great weight, and because of the substantial length between the resilient guide assemblies 80 on the lower end of the hammer carriage 72 and the upper end of the pile within which the tapered nose 96 of the hammer engages, any tendency of the pile to deviate from true vertical is resisted with tremendous forces, and these, together with the grip exerted on the lower portion of the pile by the roller pipe guide 52, maintain the pile upright as the latter is driven by operation of hammer 10. As driving ensues, the crane boom cable is lowered so that the hammer assembly follows the upper end of the pile downwardly and at least during the initial part of the driving, sufficient tension is maintained on the cable so that the mass of the hammer assembly tends to maintain the pile upright and the engagement of the socket over the upper end of the pile maintains the hammer so that its blows are applied directly downwardly onto the top of the pile. In the event that the pile hits an obstruction, or is otherwise caused to deviate from its desired direction, the vertical alignment of the pile may be corrected by swinging the crane clockwise or counter-clockwise, raising or lowering the crane boom the required amount or moving the rack holding the pile in or out or a combination of any or all of the above as the case may require. By the time the lower end of the hammer assembly approaches the outer end of the rack, the pile is sufficiently seated into the ground so that the pile guide 52 can be disengaged and the extensible part 34 of the rack withdrawn so as to clear the way for the hammer to continue driving until the pile is seated home.

What is claimed is:

1. A leadless method for driving a pile, comprising:
suspending the pile from a crane boom in vertical position with the lower end of the pile disposed on the location into which the pile is to be driven;
supporting the suspended pile against tipping and lateral movement by engaging the same at a location above the lower end thereof in a guide on the crane;
suspending over the upper end of the pile a wild hammer having a guide including a socket,
engaging the socket over the upper end of the pile; and
driving the pile downwardly by blows applied by the wild hammer to the upper end thereof while the pile is supported by the guide on the crane and while the upper end thereof is engaged in said socket, characterized by the absence of leads for supporting the pile or a pile-supporting member or the wild hammer guide.

2. A leadless method for driving a pile, comprising:
pre-excavating a hole into the ground at the location into which the pile is to be driven;
inserting a lower end portion of a pile suspended from the boom of a crane into the pre-excavated hole;
supporting the inserted pile against tipping and lateral movement by engaging and holding the same at a location above the ground in a guide on the crane;
suspending over the upper end of the pile a wild hammer having a guide including a socket
engaging the socket over the upper end of the pile; and driving the pile downwards by blows applied by the wild hammer to the upper end thereof while the upper end thereof is engaged in said socket, characterized by the absence of leads for supporting the pile or a pile-engaging member or the wild hammer guide.

3. Apparatus for leadless pile driving comprising:

a crane having a chassis and a boom;

an extensible pile guide on the crane chassis having means thereon for releasably embracing a vertically disposed pile at a location above the ground and for holding the pile upright; and a wild hammer assembly adapted to be suspended from the crane boom, said wild hammer assembly including a hammer and a hammer guide with socket means thereon for engaging over the upper end of a vertically disposed pile, said socket means including spring-biased roller means for relatively centering the pile and socket means while providing substantially free relative movement of the socket means and pile in the axial direction of the pile.

4. The combination claimed in claim 3, said extensible pile guide being disposed on the outer end of a rack, said rack having an inner portion mounted on the crane chassis and an outer portion, means mounting the outer portion on the inner portion for laterally outward and inward movement relative thereto, means for so moving said outer portion, said pile guide comprising means for releasably embracing a pile.

5. The combination claimed in claim 3, said hammer assembly comprising an elongate chassis adapted to be supported from the crane boom with the length thereof vertically disposed, means for defining an elongate open-bottom socket in the lower end of the chassis, and hammer means at the upper end of the socket.

6. The combination claimed in claim 5, and yieldable means on said chassis for centering a pile on said socket.

7. The combination claimed in claim 4, and downwardly-enlarged funnel means on the lower end of said socket for guiding the socket onto the upper end of a pile as the hammer assembly is lowered thereon.

8. Apparatus for leadless pile driving comprising:

a crane having a chassis and a boom, pile guide means having a portion extending outwardly from the crane chassis and having means on the outer end thereof for releasably embracing a vertically disposed pile at a location above the ground and holding the pile upright, said pile guide means being characterized by the absence of leads disposed between the outer end of the outwardly-extending portion and the means for releasably embracing the pile and by the fact that the means for releasably embracing the pile is disposed directly on the outer end of the outwardly-extending portion and a hammer assembly suspended from the crane boom, said hammer assembly including a hammer and socket means thereon for engaging over the upper end of a vertically disposed pile, whereby the mass of the suspended hammer assembly tends to maintain said pile vertical and the hammer is guided so that blows by the latter are applied directly downwardly onto the top of the pile.

9. A leadless method for driving a pile, comprising:

suspending the pile from a crane boom in vertical position with the lower end of the pile disposed on the location into which the pile is to be driven;

then supporting the suspended pile against tipping and lateral movement by engaging the same at a location above the lower end thereof and at a location spaced outwardly from the crane chassis in a guide on the crane chassis;

suspending over the upper end of the pile a wild hammer having a guide including a socket;

then engaging the socket onto the upper end of the pile; and driving the pile downwardly by blows of the wild hammer applied to the upper end thereof while the pile is supported by the guide on the crane chassis and while the upper end thereof is engaged in the socket of said wild hammer guide.

* * * * *